US005782180A

United States Patent [19]

Schneider et al.

[11] Patent Number: 5,782,180

[45] Date of Patent: Jul. 21, 1998

[54] SPRAY DAMPER

[75] Inventors: Georg Schneider, Würzburg; Martin Heinz Schoeps, Güntersleben, both of Germany

[73] Assignee: Koenig Bauer-Albert Aktiengesellschaft, Wurzburg, Germany

[21] Appl. No.: 765,172

[22] PCT Filed: Jul. 6, 1995

[86] PCT No.: PCT/DE95/00883

§ 371 Date: Jan. 9, 1997

§ 102(e) Date: Jan. 9, 1997

[87] PCT Pub. No.: WO96/01740

PCT Pub. Date: Jan. 25, 1996

[30] Foreign Application Priority Data

Jul. 9, 1994 [DE] Germany ..... 44 24 301.4

[51] Int. Cl.[6] ..... B41F 7/30; B41F 7/26

[52] U.S. Cl. ..... 101/148

[58] Field of Search ..... 101/147, 148, 101/366; 118/302, 313, 314; 239/162

[56] References Cited

U.S. PATENT DOCUMENTS

| | | | |
|---|---|---|---|
| 4,044,674 | 8/1977 | Smith, Jr. . | |
| 4,469,043 | 9/1984 | Kohler et al. | 118/63 |
| 4,719,129 | 1/1988 | Caudill | 427/348 |
| 4,815,375 | 3/1989 | Switall et al. . | |
| 5,438,923 | 8/1995 | Schoeps | 101/147 |

FOREIGN PATENT DOCUMENTS

| | | |
|---|---|---|
| 0 422 400 | 4/1991 | European Pat. Off. . |
| 589 821 | 11/1933 | Germany . |

*Primary Examiner*—J. Reed Fisher

*Attorney, Agent, or Firm*—Jones, Tuller & Cooper, P.C.

[57] ABSTRACT

A spray dampening device for a printing press utilizes a plurality of magazines, each of which is assigned to cover a spray area on a dampening cylinder. Each magazine includes at least one active dampening fluid spray nozzle and one reserve, freshly prepared spray nozzle. The active nozzle can be moved out of its active position and can be replaced by the reserve nozzle if a reduction in the print quality of the press is noted.

15 Claims, 5 Drawing Sheets

SPRAY DAMPER

FIELD OF THE INVENTION

The invention relates to a device for dampening articles, in particular to a dampening agent roller of an offset rotary printing press.

DESCRIPTION OF THE PRIOR ART

It is generally known in connection with offset printing processes to employ, besides inking units, also dampening units, for example nozzle dampening units with spray nozzles arranged next to each other in the axial direction, for dampening the printing cylinder; see, for example, U.S. Pat. No. 40 44 674. It is disadvantageous in connection with such nozzle systems that it is possible for changes in the geometry of the nozzle outlet openings to occur as a result of wear or soiling of the nozzle openings, so that a high quality print image can no longer be obtained. It is necessary to replace the nozzles to remove these deficiencies, which results in down-time for the press and loss of production.

SUMMARY OF THE INVENTION

It is the object of the invention to create a device for dampening a dampening agent roller of a rotary printing press by means of nozzles.

A device for dampening a dampening agent roller of a rotary printing press with a spray medium uses a plurality of spray nozzles that are arranged next to each other in a spray dampening unit. A spray area and an operating position is assigned to each nozzle. One magazine that is assigned to each spray area is structured to receive at least two spray nozzles. In each of these magazines at least one of the spray nozzles is held in a reserve position and can be moved from the reserve position to an operating position where it will be connected with a source of the spray medium. Each spray nozzle can be moved back to its reserve position.

The advantages of the invention reside in particular in that it is possible to make an immediate change of the spray nozzles in case of the worsening of the print image, without this resulting in a loss of production. The device in accordance with the invention is also suitable for spraying other than the articles named in the specification with dampening agent or ink, and it can be employed wherever spray nozzles might become clogged.

BRIEF DESCRIPTION OF THE DRAWINGS

The invention will be described in detail below by means of several exemplary embodiments. The associated drawings show in FIG. 1, a schematic representation of a cross section through a first preferred embodiment of a spray dampening device in accordance with the invention, FIG. 2, a view taken in the direction of arrow A of FIG. 1, but without the front part of the housing and without a dampening distribution roller, FIG. 3, a lateral view of another arrangement of the shaft of the magazines, FIG. 4, a top view of FIG. 3, FIG. 5, a schematic view of the representation of a second exemplary embodiment of a device in accordance with the invention, but without the housing, FIG. 6, a schematic sectional view of a third exemplary embodiment of a device in accordance with the invention, but without the housing, FIG. 7, a representation of FIG. 6, but with a replaced spray nozzle, FIG. 8, a partial section taken along line VIII—VIII of FIG. 6 in an enlarged representation, FIG. 9, a partial section taken along line IX—IX of FIG. 6 in an enlarged representation, FIG. 10, a section taken along line X—X of FIG. 9, FIG. 11, a schematic representation of a cross section through a device in accordance with the invention with a rotatable nozzle magazine with a special dampening agent supply line in a fourth exemplary embodiment, FIG. 12, a schematic representation of a longitudinal section through a device in accordance with the invention with a displaceable nozzle magazine with a special dampening agent supply line in a fifth exemplary embodiment.

DETAILED DESCRIPTION OF THE PREFERRED EMBODIMENTS

Figure 1:
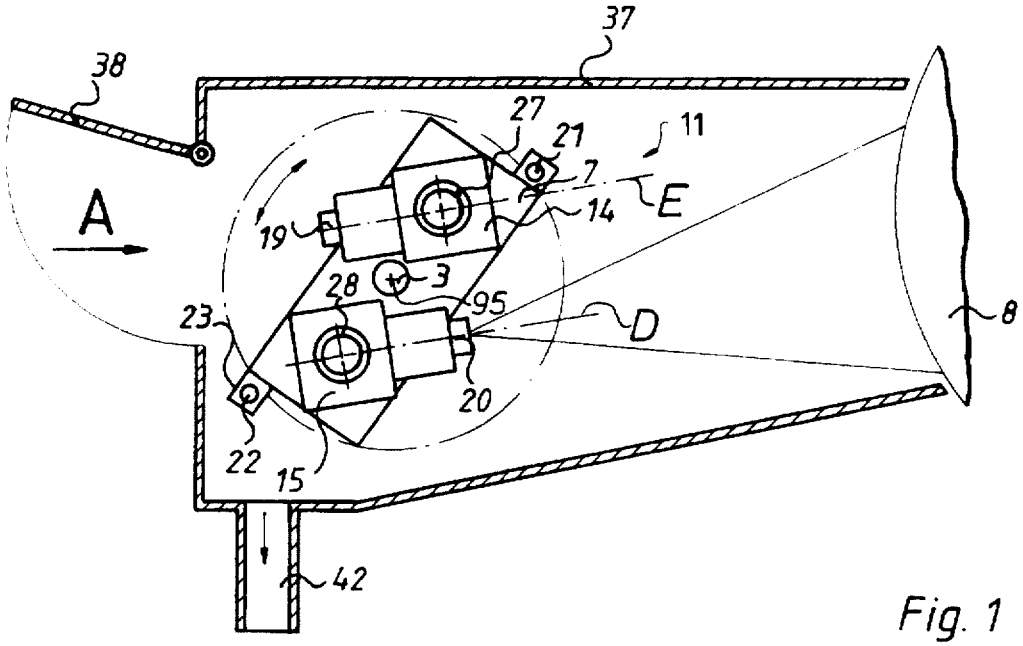
Figure 2:
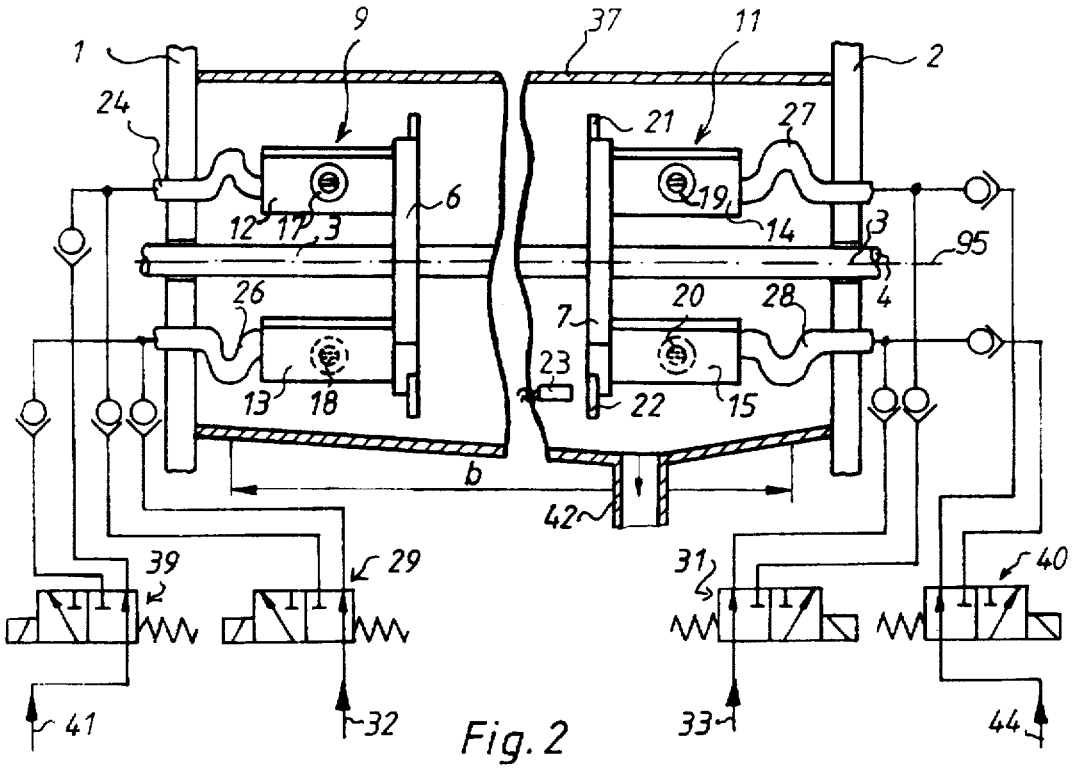

Referring initially to FIGS. 1 and 2, a shaft 3 is rotatably seated in a lateral frame 1, 2 and connected via a shaft end 4 with a drive element, not shown, for example an adjustment lever for manual operation or with a known electric motor drive. Two or more supports 6, 7, for example in the shape of rectangular plates, are disposed perpendicularly in respect to the shaft 3 and interlockingly fastened on the shaft 3, which receive a plurality of, for example four, magazines for spray nozzles (however, only two magazines 9, 11 are represented in FIG. 2), which extend over the entire dampening width b of a dampening agent roller 8 in an axis-parallel direction in respect to the dampening agent roller 8, and are identified by 9 and 11 as a whole. Each magazine 9, 11 has nozzle fastening elements or nozzle supports 12, 13, 14, 15 fixedly disposed on the ends of the supports 6, 7, in which spray nozzles 17, 18, 19, 20 are fastened in turn. The spray nozzles 17 to 20 are arranged on the supports 6, 7 in such a way that the respectively lower spray nozzle 18, 20 is directed on the surface of the dampening agent roller 8 (operating or spray direction D). If the magazines 9, 11 are rotated on their common shaft 3 in a counterclockwise direction (FIG. 1) by 180° around their axis of rotation 95 from a maintenance and reserve position E into the operating position D, the spray nozzles 17, 19 are put into operation and they are directed on the surface of the dampening agent roller 8, namely at the same place as previously the nozzles 18, 20. A strip-shaped lug 21 or 22 is fastened on at least one end of the support 7, which is in connection with a sensor 23, fixed in place on the housing. Each nozzle support 12 to 15 is connected via a dampening agent supply, for example in the form of a flexible hose 24, 26, 27, 28 and respectively one directional control valve 29, 31 with respectively one central dampening agent line 32, 33 (dampening agent source). It is also alternatively possible to connect each nozzle support 12 to 15 via a further directional control valve 39, 40 with respectively a central line 41, 44 for cleaning fluid (also identified as dampening agent source) in order to be able to clean the spray nozzles 17 to 20 when required as seen in FIG. 2.

Another option for cleaning the spray nozzles 17 to 20 consists in respectively connecting the spray nozzles 17, 19 (FIGS. 1, 2), which are in the position of rest, i.e. facing away from the dampening agent roller 8, with a nozzle cleaning device in order to spray these nozzles 17, 19 with a cleaning fluid and to clean them simultaneously mechanically, for example with a rotating brush head. The nozzle cleaning device can be disposed pivotably on a shaft fixed in place on the lateral frame and, if required, displaceably in the axis-parallel direction in respect to the dampening agent roller 8, wherein the housing can be designed to be larger than the one represented in FIG. 1. It is also possible to turn the magazines 9, 11 for the spray nozzle in a clockwise direction.

In connection with one of the lugs 22, 21, the sensor 23 signals a rotating movement of the magazines 9, 11 and causes the connection with, disconnection from or switching of the dampening agent from the spray nozzles 18, 20 to the spray nozzles 17, 19 via the directional control valves 29, 31, which can be electrically actuated. The magazines 9, 11 of the spray dampening unit are enclosed in a housing 37, which is open in the direction toward the dampening agent roller 8 and which has on the opposite side a flap 38, which can be upwardly pivoted for operational purposes. At a low-lying point, the housing 37 has a return 42 for the return of the dampening agent not applied to the dampening agent roller 8. The dampening agent roller 8 is connected with a dampening agent distribution roller, not shown, and with a printing cylinder, not shown. Thus each spray nozzle required for the printing or dampening purpose is multiply provided, at least twice, so that in case of the outage of a spray nozzle 18, 20, which had been operating up to that time, a fresh, ready reserve spray nozzle 17, 19 is employed by means of a rotating movement of the magazine 9, 11.

It is also possible to design the shaft 3 so that it can be separately driven for each magazine 9, 11.

Figure 3:
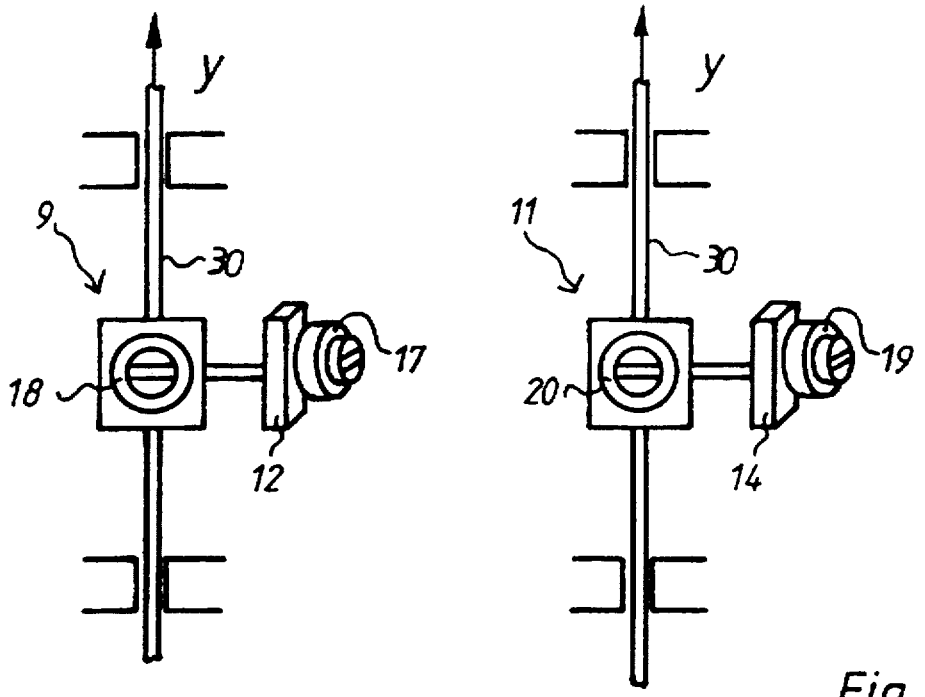
Figure 4:
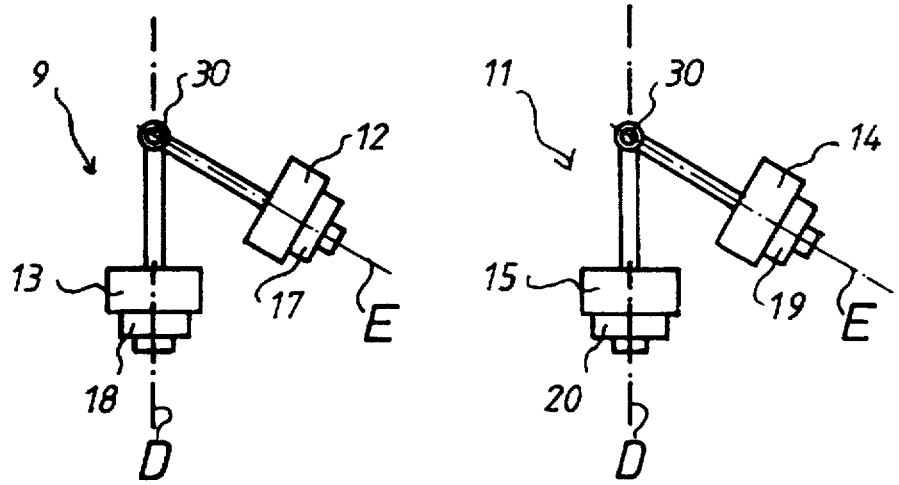

It is also possible to dispose a shaft 30 vertically, i.e. in the y-direction of a right-angled coordinate system, and then to turn the magazine 9 or 11 into an appropriate operating position D as shown schematically in FIGS. 3 and 4. In this case several shafts 30 must be employed, which can be turned by means of known drive elements and which can be scanned as to their respective position by means of sensors, not shown. The representation of hoses for the dampening agent supply, as well as a housing was omitted. Reference is made to FIGS. 1 and 2 for a depiction of these omitted elements.

It is possible in the same way to dispose one or several shafts 30 in the z-direction of a right-angled coordinate system as well as at right angles to the dampening agent roller 8, and then to turn the magazines 9, 11 in an analogous manner with this which is not specifically depicted in the drawings.

Figure 5:
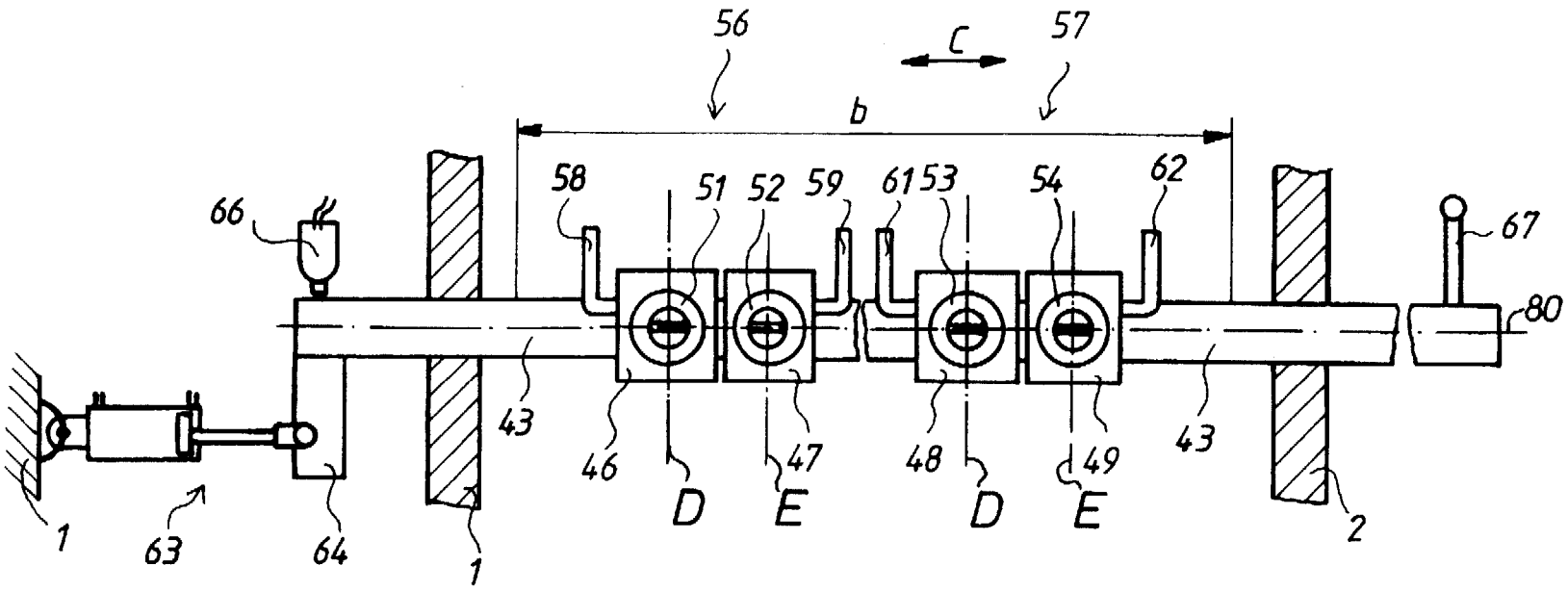

In a second preferred embodiment of a spray dampening device in accordance with the present invention, as seen in FIG. 5 a nozzle bar or a nozzle support 43 for receiving nozzle supports 46, 47, 48, 49, arranged next to each other, is disposed in a lateral frame 1, 2, and can be moved back and forth in a direction parallel with the dampening roller along longitudinal axis 80. Spray nozzles 51, 52, 53, 54 are associated with the respective nozzle supports 46 to 49 and are at least arranged in pairs next to each other. It is also possible to provide four or eight pairs of spray nozzles per dampening width b of the dampening agent roller 8 or any other arbitrary number of pairs of spray nozzles. Respectively, one pair of spray nozzles 51, 52; 53, 54 arranged next to each other constitutes a magazine 56, 57. A spray area is assigned to each magazine. A spray area is that area on the dampening agent roller 8 which is to be sprayed. Flexible hoses 58, 59, 61, 62 for supplying dampening agent are assigned to the nozzle supports 46 to 49 respectively, wherein the supply per magazine 56, 57 can take place analogously to the representation in FIG. 2 via directional control valves 29, 31. A back-and-forth movement of the nozzle carrier 43 in the axial direction C can take place by means of a known toothed rack gear or by means of a double-acting cylinderpiston unit 63, which is disposed between the lateral frame 1 and a bracket 64, which is fastened on the nozzle support 43 by means of a material-to-material contact. A sensor 66, fixed in place on the frame above the nozzle support 43 detects by means of marks located on the nozzle support 43 which spray nozzles must be charged with dampening agent. Corresponding to the representation in FIG. 3, at this time the spray nozzle 51 of the magazine 56, as well as the spray nozzle 53 of the magazine 57 are in an operating position D, while the spray nozzles 52, 54 are in a reserve position. By means of a shift of the nozzle support 43 in the direction toward the left lateral frame 1, the spray nozzles 52, 54 get into action. The shift can also take place by means of an alternatively represented handle 67 that is also shown in FIG. 5. The spray nozzles 51, 53 which are respectively in the operating position D have directed their spray onto the dampening agent roller 8, not shown in FIG. 5. The representation of a housing was also omitted here.

It is also possible to divide the nozzle support 43, to seat it separately in the lateral frame 1, 2 and to separately displace it per magazine 56, 57.

Figure 6:
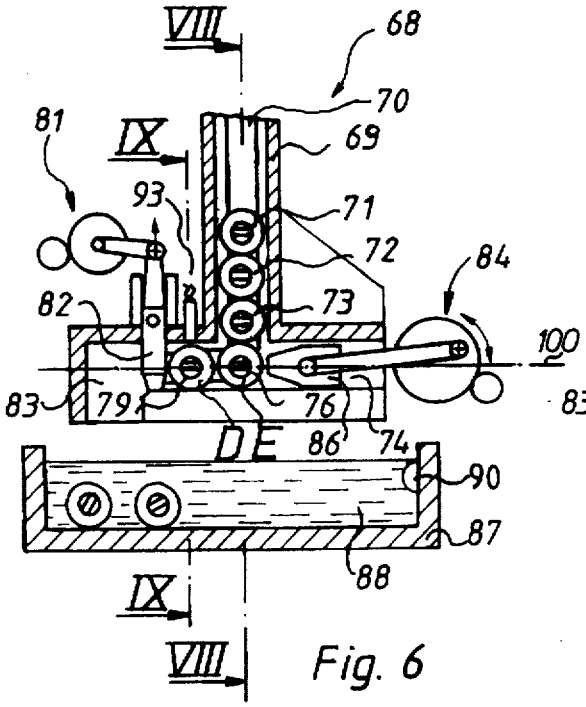
Figure 7:
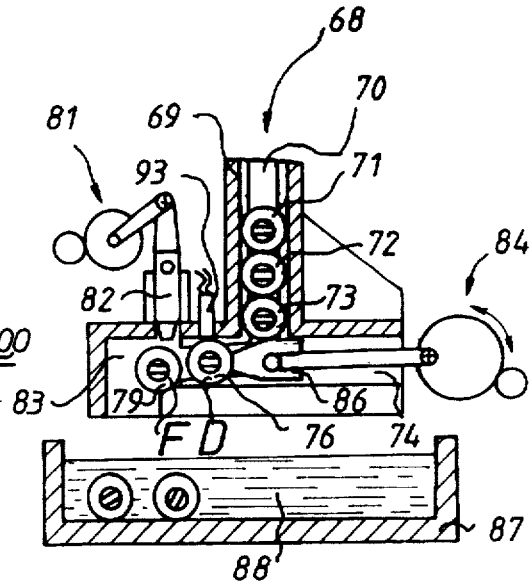
Figure 8:
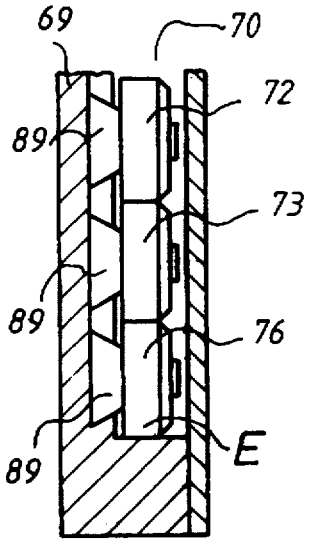
Figure 9:
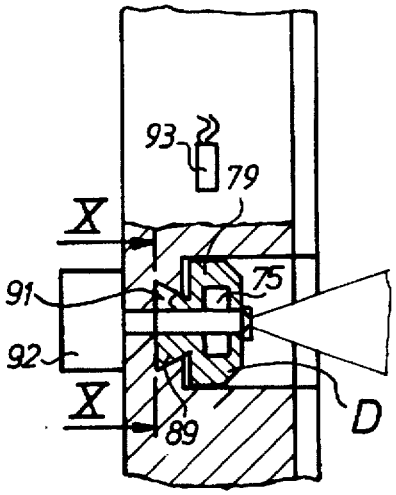
Figure 10:
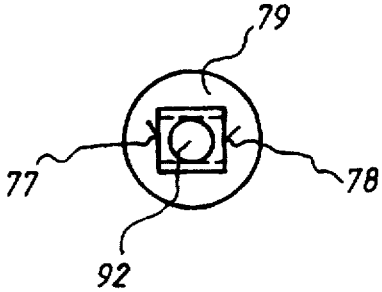

In a third preferred embodiment, as showing in FIGS. 6 to 10, of a device in accordance with the present invention, a magazine 68 respectively disposed fixed in place on a lateral frame, for example a cross bar, not shown, consists of a vertically extending supply 69 with a supply shaft 70 for cleaned spray nozzles 71, 72, 73. The vertically extending supply shaft 70 terminates in a operating shaft 74 located below it and extending horizontally, in which a further cleaned spray nozzle 76 is in a reserve position E under the last spray nozzle 73, all as shown in FIG. 6. Because of gravity acting on them, the stacked spray nozzles 71, 72, 73, 76 slide downward, and in the process they are guided downward by their lateral edges 76, 77 in the correct position in the supply shaft 70 in the direction toward the operating shaft 74, so that it is possible to employ fan jet nozzles and to exchange them in the right position. In case a reduction in the print quality, which is connected with the dampening agent supply, is detected, the defective spray nozzle 79, which is in the operational state or operating position D as shown in FIG. 7, is removed. This is accomplished in that a blocking slide 82 is pulled up by means of a drive element 81, so that now there is a connection between the first end of the operating shaft 74 and a drop shaft 83 which has now been opened. Subsequently, the defective nozzle 79 is pushed by means of a positioning piston 86 which is also identified as positioning device 86 provided with a drive element 84, which moves from the direction of the second end of the operating shaft 74 in the direction toward the blocking slide 82 along an axis 100 into the drop position F, where it free-falls into a container 87, which can be filled with a cleaning fluid 88, if required, wherein in this case an ultrasonic transmitter 90 can be attached to the lateral wall of the container 87 for the purpose of intensive cleaning of the spray nozzles. The blocking slide 82 is now closed and the position piston 86 pushes the spray nozzle 76, which has been cleaned and is in the lowermost position on the level of the operating shaft 74 sufficiently far in the direction of the first end of the operating shaft 74 that the spray nozzle 76 is in contact with the blocking slide 82, i.e. is in the operating position D, as may be seen in FIG. 7. In this case the spray nozzle 76, as well as all other spray nozzles 79, 71,72, 73, also has a guide 89, for example a dovetailed guide, on its back, as seen in FIGS. 8,9, and 10, which is led in a groove 91 with a dovetail-shaped cross section located in the rear longitudinal side of the operating shaft 74. The changing of the spray nozzle 76 takes place as follows: in place of the defective spray nozzle 79, a dampening agent supply or dampening agent source 92 arranged in the rear longitudinal side 91 of the operating shaft 74 is turned off with the aid of a sensor 93, which detects the presence of a spray nozzle 79, 76, together with a magnetic valve, not shown, so that no dampening agent emerges from the dampening agent source 92 during the changing procedure. The drive elements 81, 84 can consist of known drive elements for a back-and-forth movement. Preferably several magazines 68 can be disposed next to each other over the entire dampening width b of the dampening agent roller 8. Thus, respectively the spray nozzle 76 or 79 which is in the operating position D sprays in the direction toward the dampening agent roller 8. A housing is not shown. A pre-chamber 75 of a spray nozzle 79 in the operating position D is shown in FIG. 9, representing all other spray nozzles.

Figure 11:
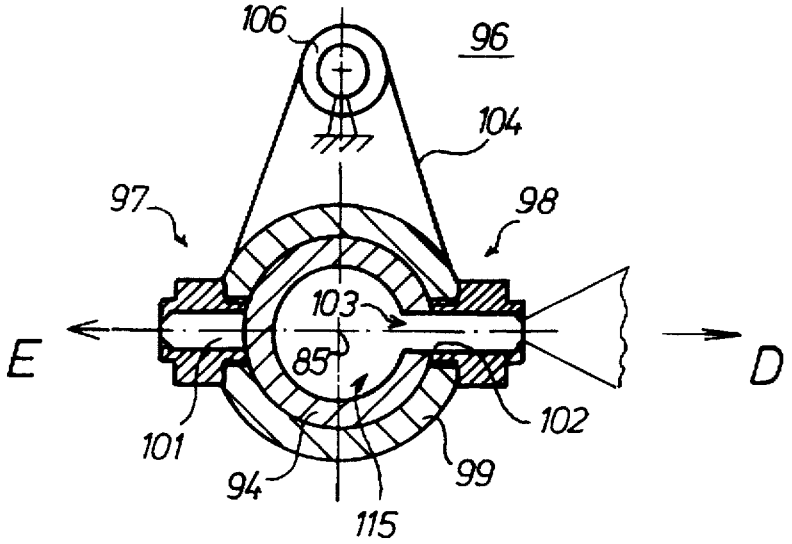

In a fourth preferred embodiment of a spray dampening device in accordance with the present invention as shown in FIG. 11, a dampening agent supply device 94 in the shape of a pipe with an axis of rotation 85 and extending in a direction parallel with the dampening agent roller is provided fixed in place on the lateral frame. Spaced apart magazines 96 for receiving spray nozzles 97, 98 are rotatably disposed on the pipe 94 around an axis of rotation 85 over the entire dampening width b, in that a nozzle support 99 formed, for example, in the shape of a tube-shaped sleeve 99, respectively receives the spray nozzles 97, 98 in a diametrically opposite arrangement on its circumference. For example, the spray nozzles 97, 98 can be provided on their ends remote from the nozzle outlet with a threaded nipple 101, 102, which interlockingly engages a threaded bore in the tube or sleeve 99. The tube or sleeve 99 has a bore or recess 103, oriented in the spraying direction toward the dampening agent roller 8 which, in the operating position D, together with the bore of the threaded nipple 102, forms an opening for the dampening agent to be applied. In this case the diametrically oppositely located reserve spray nozzle 97 is sealed against the pipe 94 supplying the dampening agent. With a dampening agent roller 8 of appropriate size or another large spray area, it is also possible to turn the sleeve 99 on the pipe 94 in such a way that the opening between the threaded nipple 102 and the recess 103 becomes reduced in cross section. On its circumference the sleeve 99 is provided with teeth, not shown, which are rotatably connected by means of a toothed belt 104 with a gear-motor unit 106 that is fixed in place on the frame, and which can be operated from the control stand of the press, for example. However, it is also possible to rotate the sleeve 99 manually. The sleeve-shaped nozzle support 99 is sealed on the pipe-shaped dampening agent supply device 94 against emerging dampening agent, for example by means of O-rings, not shown. In this way, all magazines 96 arranged on the dampening agent supply pipe 94 are centrally supplied with dampening agent. The pipe or the dampening agent supply is connected with a symbolically represented dampening agent source 115.

Figure 12:
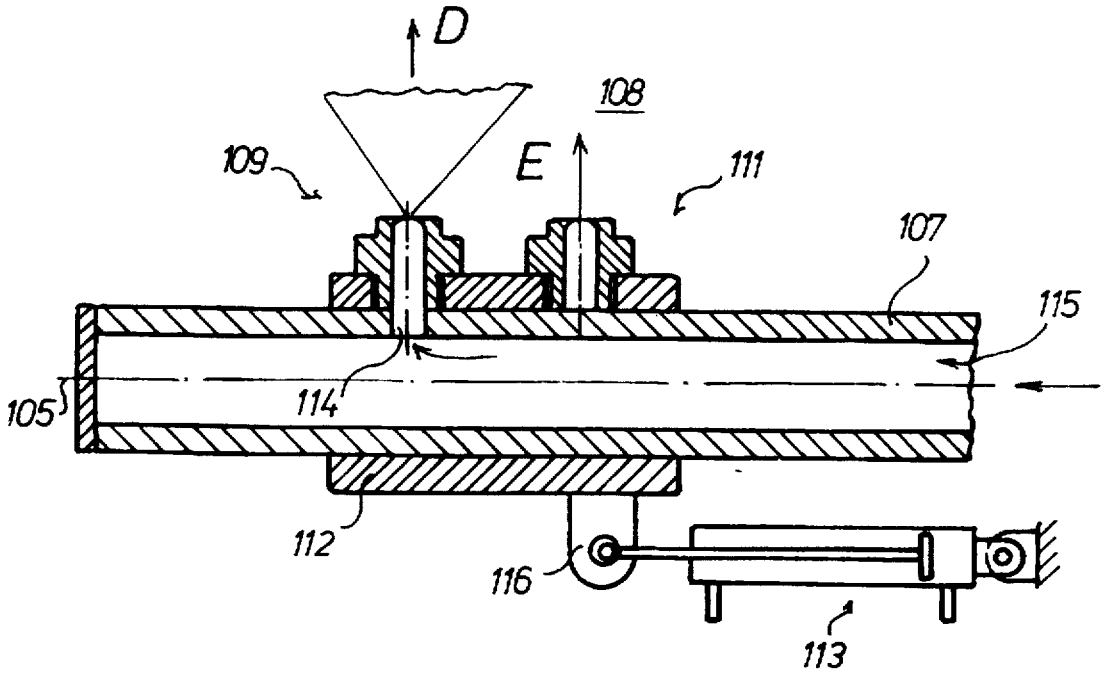

In a fifth preferred embodiment of a spray dampening device in accordance with the present invention as seen in FIG. 12, a dampening agent supply line 107 in the form of a pipe, extending in a direction parallel with the dampening agent roller and fixed in place on the lateral frame, has again been provided. Spaced apart magazines 108 to receive spray nozzles 109, 111 are arranged on the pipe 107 over the entire dampening width b. The spray nozzles 109, 111 are arranged behind each other in an axis-parallel direction with the dampening agent supply line 107 and, spaced apart from each other, are connected with a pipe-shaped, sleeve-like nozzle support 112 and are therefore also bolted together with the nozzle support 112 as explained in the prior exemplary embodiment. The nozzle support 112 is disposed on the dampening agent supply line 107 so it can be moved back and forth, i.e. displaceably, in the axial direction of the dampening agent supply line 107 in the direction of the axis of rotation 105 by means of a double-acting pneumatic cylinder-piston unit 113, so that selectively one of the two spray nozzles 109, 111, coming from a reserve position E, is connected with a bore or recess 114 of the dampening agent supply line 107, which, in the operating position D, is oriented toward the dampening agent roller 8. With one of the spray nozzles 109, the recess 114 forms an outlet for the dampening agent to be applied, while the reserve spray nozzle 111 is sealed against the pipe 107 supplying the dampening agent. The sleeve-shaped nozzle support 112, as well as the dampening agent supply, are sealed against each other by known sealing means in such a way that no dampening agent can emerge. On one side, the cylinder-piston unit 113 is seated fixed in place on the lateral frame, and on the other side is hingedly connected with the nozzle support 112 by means of a bracket 116. One stroke length of the cylinder-piston unit 113 corresponds to the distance between both spray nozzles 109, 111 on the nozzle support 112. The cylinder-piston unit 113 can be operated, for example, from the press control stand. The space requirement of this device in accordance with the invention is particularly small because of the axis-parallel arrangement of the spray nozzles and of their displacement movement of the nozzle magazines 108 extending in the axis-parallel direction in respect to the dampening agent roller. Easy handling is provided with this compact construction of the spray dampening unit.

The spray device in accordance with the present invention is also suited for spraying other articles than the dampening agent roller 8 mentioned in the above description. For example, spray nozzles with the device can be changed wherever spray nozzles can become clogged in use, for example when spraying dampening agent or ink. This of course also applies when the spray image changes because of wear of the spray nozzle.

A pre-chamber, which is only depicted in detail in FIG. 9, is located between each spray nozzle. Each nozzle also has a housing, with which it is releasably connected. Regarding the structure of nozzles, in particular fan jet nozzles, reference is made to a catalog of Lechler GmbH+Co. KG, Post Office Box 1709, D-70707 Fellbach, "Die ganze Welt der Dusentechnik" [The Whole World of Nozzle Technology], Catalog 10.92, Edition 921.

It is obvious that the spray nozzles, which are removed from an operating position D in the magazines after use, are afterwards again replaced by new or reclaimed spray nozzles.

Furthermore, it is possible to embody the described magazines 9, 11 as shown in FIG. 1 and 2 with a central dampening agent supply 115 for the magazine 96 described in connection with FIG. 11. In this case, the shaft 3 is hollow and is connected with a dampening agent source 32 or 33 supplying the spray medium, for example an aqueous dampening agent. In an advantageous manner, the hoses 24 and 26 to 28, which up to now were separately conducted to the spray nozzles 17 to 20, can then be omitted. In place of this, the hollow shaft 3 is provided in the radial direction with one recess, not shown, per magazine 9, 11, through which the spray medium can emerge. The magazines 9, 11 are rotatably disposed on the hollow shaft 3 by means of arms 6, 7. The bores, not shown, are respectively contained in the arms 6, 7, and connect the spray nozzles 18, 20, which are respectively in the operating position, with the recess located in the hollow shaft 3 for the purpose of supplying the spray medium, for example dampening agent. The reserve spray nozzles, for example 97, 111, which are in the reserve position E, then have no contact with the recesses in the hollow shaft 3. The recesses in the hollow shaft 3 are sealed against the ends close to the shaft of the bores located in the arms by known means in such a way that the spray medium only emerges through the spray nozzles 18, 20 which are in the operating position D.

Therefore, in accordance with the above description, the concept of the invention resides in that defective operating spray nozzles, for example 98, 109, which are in an operating position D, can be replaced at any time by freshly "stocked" reserve spray nozzles "waiting" in a reserve position E. A reason for replacing a spray nozzle, for example 98, 109, can be that irregularities are detected in the dampening agent supply in connecting with a reduction in the printing quality in the area of a "working" spray nozzle. The supply of the reserve spray nozzles, for example 97, 111, from the reserve position E into the operating position D and vice versa can take place displaceably on an arc of a circle around the axis of rotation 30, 85, 95 or along an axis 80, 100, 105 extending parallel along the area to be dampened.

This can take place automatically as well as controlled from the press control stand or manually. In this case the running speed of the press need not be reduced. In an advantageous way only negligible waste is generated.

In an advantageous manner, it is also possible to stock spray nozzles, for example 97, 111, which are in the reserve position E and have other technical characteristics, for example a different nozzle cross section or a different spray pattern. It is therefore possible to have technically different nozzles in one magazine which then, depending on the purpose of use, can be brought into an operating position D for example, it would be possible to use the nozzles 97, 111 as detergent nozzles for cleaning the dampening agent roller 8.

While preferred embodiments of a spray dampening device in accordance with the present invention have been set forth fully and completely hereinabove, it will be apparent to one of skill in the art that a number of changes in, for example, the type of printing press, the drive for the dampening roller, the size of the dampening roller and the like can be made without departing from the true spirit and scope of the present invention which is accordingly to be limited to the following claims.

What is claimed is:

1. A spray dampening device for use in supplying a dampening agent to a dampening agent roller in a rotary printing press comprising:

a dampening agent roller in a rotary printing press, said dampening agent roller having a plurality of spray areas;

a magazine assigned to each said spray area of said dampening agent roller;

at least first and second dampening agent spray nozzles positioned in each said magazine, one of said at least first and second dampening agent spray nozzles in each said magazine being in an operating position and being usable to spray dampening agent completely on said spray area assigned to each said magazine, another of said at least first and second spray nozzles in each said magazine being in a reserve position; and means to move said another of said at least first and second dampening agent spray nozzles in each said magazine from said reserve position into said operating position in response to a failure of said one of said first and second dampening agent spray nozzles in said operating position to spray said dampening agent completely on said spray area assigned to each said magazine.

2. The spray dampening device in accordance with claim 1 wherein each said magazine is disposed for rotation about an axis of rotation which extends parallel to a surface of said dampening agent roller.

3. The spray dampening device of claim 1 wherein each said magazine is displaceable between said reserve position and said operating position along an axis which extends parallel to a surface of said dampening agent roller.

4. The spray dampening device in accordance with claim 1 wherein each said magazine is rotatably supported on a pipe secured in place on a lateral frame of said rotary printing press.

5. The spray dampening device of claim 1 wherein each said magazine is displaceably supported on a pipe secured in place on a lateral frame of said rotary printing press.

6. The spray dampening device of claim 1 wherein each said magazine is pivotably arranged on a common shaft disposed fixed in place on a lateral frame of said rotary printing press.

7. The spray dampening device of claim 1 wherein each said magazine is pivotably arranged on a separate shaft disposed fixed in place on a lateral frame of said rotary printing press.

8. The spray dampening device of claim 1 wherein each said magazine is arranged on an axially displaceable nozzle support disposed on a lateral frame of said rotary printing press.

9. The spray dampening device of claim 1 wherein each said spray nozzle in each said magazine is displaceable between said operating and said reserve position by a positioning device.

10. The spray dampening device of claim 1 wherein each said spray nozzle is further shiftable from said operating position into a drop position by a positioning device.

11. The spray dampening device of claim 1 further including a housing and an operating shaft for each of said spray nozzles, said housing having a dampening agent supply side, said operating shaft being on said dampening agent supply side of said housing, each of said spray nozzles being movable in an axial direction with respect to said dampening agent roller in said operating shaft, each said spray nozzle, when in said operating position, being in connection with a dampening agent source through said housing and said operating shaft.

12. The spray dampening device of claim 4 further including a dampening agent source connected with said pipe, said pipe having a recess for each said magazine, said spray nozzle in each said magazine being connected to said dampening agent source through said recess when in said operating position.

13. The spray dampening device of claim 1 wherein each said spray nozzle includes a pre-chamber and further wherein each said pre-chamber is connected by a separate hose to a dampening agent source.

14. The spray dampening device of claim 1 further including a dampening agent supply source and a dampening agent supply having a plurality of recesses, said dampening agent supply receiving dampening agent from said dampening agent supply source and supplying said dampening agent to said spray nozzles through said recesses.

15. The spray dampening device of claim 1 further including a common dampening agent source and wherein each of said spray nozzles is connectable to said common dampening agent source.

* * * * *